United States Patent [19]

Barr

[11] 4,300,763

[45] Nov. 17, 1981

[54] PSYCHOLOGICAL GAME DEVICE

[76] Inventor: Samuel J. Barr, 1855 Medical Dr., Titusville, Fla. 32780

[21] Appl. No.: 123,297

[22] Filed: Feb. 21, 1980

[51] Int. Cl.[3] ..... A63F 9/00

[52] U.S. Cl. ..... 273/1 E; 434/236

[58] Field of Search ..... 273/1 E, 1 R, 1 M, 138 A; 35/22 R, 9 B; 368/108, 109; 434/236

[56] References Cited

U.S. PATENT DOCUMENTS

| | | | |
|---|---|---|---|
| 2,994,531 | 8/1961 | Eberwein | 273/1 E |
| 3,136,114 | 6/1964 | Jauch | 368/109 |
| 3,503,608 | 3/1970 | Ylinen | 35/22 R X |
| 3,531,114 | 9/1970 | Parks et al. | 273/1 E |
| 4,205,464 | 4/1980 | Baggott | 35/9 B X |

FOREIGN PATENT DOCUMENTS

| | | | |
|---|---|---|---|
| 52-65481 | 5/1977 | Japan | 368/109 |
| 1497710 | 1/1978 | United Kingdom | 273/1 E |

OTHER PUBLICATIONS

Popular Electronics, 7-1974, pp. 27-32.

*Primary Examiner*—Paul E. Shapiro

*Attorney, Agent, or Firm*—Duckworth, Allen, Dyer & Pettis

[57] ABSTRACT

A psychological game device having a small box-like cabinet with a panel facing a player called the SPEAKER and another panel facing a player called the LISTENER. The SPEAKER panel mounts two push buttons labeled TRUTH and ALMOST TRUTH. The LISTENER panel mounts two push buttons labeled BELIEVE and ALMOST BELIEVE. The bottom of the cabinet includes a recessed panel with scoring indicators labeled CREDIBLE consisting of three light emitting diodes (LEDs) and FORGET-IT consisting of three LEDs. A reset button is also provided. The top surface of the cabinet contains an on/off switch, a START push-button, and an LED indicator. A timer circuit, started by the START button, illuminates the indicator LED for either a preselected time period or a sequence of random duration time periods. Logic circuits contained within the cabinet are controlled by the SPEAKER and LISTENER push buttons to provide a basic game sequence of three periods. The device may be used with a wide variety of games limited only by the imagination of the players.

4 Claims, 4 Drawing Figures

PSYCHOLOGICAL GAME DEVICE

BACKGROUND OF THE INVENTION

The present invention relates to novelty games and more particularly to an electronic game, involving psychological factors, which may be played by two persons.

Games have always held an appeal for persons of all ages. Games which involve psychological factors are popular with those having some intellectual maturity. With the development of the electronic art and with circuits capable of performing logic operations, it is possible to develop games in which players enter information into a device that performs certain logic operations on such information and produces indications to the players of their success or failure in the games. Such capabilities are therefore usable in a variety of game-type devices. The present invention falls in this category and provides a device for games to be played by two participants. However, it is also suitable for use at parties or the like in which a number of spectators may experience enjoyment from the actions and reactions of the two players.

SUMMARY OF THE INVENTION

The present invention may utilize a small cabinet or box which may be referred to as the "truth box". The box may contain on its top surface, an on/off switch, a pilot light, and a push button. Within the box is a timing device which may be preset to a desired period. For example, a period of ten seconds is typical. In operation, a first player, who may be termed the speaker, turns on the truth box and depresses the start button momentarily. This action initiates the timer and illuminates the pilot light. The pilot light will remain on during the timing period at which time it will be extinguished. In a "Truth Game", the speaker may make statements, ask questions, or answer questions with the restriction that he must speak the perfect truth during the timing period when the pilot lamp is illuminated. After the pilot light goes off, the speaker may make statements which may or may not be truthful. The listener must agree to accept all statements in the spirit of the game without holding any ill feelings toward the speaker. Similarly, as the speaker asks questions of the listener, the listener must answer subject to the same restrictions.

A more sophisticated game may be played with certain additional features of the truth box in what may be called the "Credibility Game". For this purpose, the cabinet is provided with two opposite panels with one faced toward the speaker and the opposite panel faced toward the listener. The speaker's panel has a push button labeled TRUTH and a second push button labeled ALMOST TRUTH. The listener's panel has a push button labeled BELIEVE and a second button labeled ALMOST BELIEVE. The bottom of the cabinet is slightly recessed to provide clearance for a reset button and two sets of indicator lights. The first set of indicator lights may contain three lights and be labeled CREDIBLE. The second set also contains three lights and is labeled FORGET-IT. During the game, the indicator lights are not visible to the players when the cabinet is in its normal upright position.

To play the game, the player designated as the speaker starts the timer as previously described, and makes statements, asks questions, or answers questions. During such statements, the speaker is not necessarily required to speak the truth and pushes one of the two buttons depending on the nature of his statement. For example, if the speaker is in fact speaking the truth, he will press the TRUTH button. Otherwise, he presses the ALMOST TRUTH button. The listener, as he hears the speaker's statements, evaluates the credibility of the statements and presses a button which indicates his opinion of the speaker. Thus, for example, if he believes that the speaker is indeed telling the truth he will press the BELIEVE button. Otherwise, he will depress the ALMOST BELIEVE button. If, at the start of the game, the speaker pushes the TRUTH button and the listener pushes the BELIEVE button, the number one CREDIBLE light on the bottom panel of the cabinet will turn on. On the other hand, if the speaker is telling the truth and the listener depresses the ALMOST BELIEVE button, then the number one FORGET-IT lamp will turn on. As may now be recognized, if the listener pushes the button matching that of the speaker, he receives a CREDIBLE light and gains a point in the game. If he does not match the speaker, the FORGET-IT lamp will light and the speaker gains a point.

When the timer extinguishes the pilot lamp, the speaker may reinitiate the timer and proceed with another sequence of statements. After three sets of statements, the cabinet is inverted and a score determined. If the listener is able to cause two or more CREDIBLE lamps to be lighted, he wins that round. Otherwise, the speaker will have two or more FORGET-IT lamps lighted and he will win. After one game, the box may be reversed and the previous listener may become the speaker. After the completion of a game, a reset button on the base panel is depressed which extinguishes all of the indicator lamps and resets the box for the next game.

As may be recognized, the listener must attempt to interpret what the speaker says, his tone of voice, his expression and other psychological indications to determine whether he is being truthful or not. Spectators may note from observing which buttons are being pressed, what the correct nature of the speaker's statements are and may be amused by the listener's reactions and attempts to interpret what the speaker is saying. Alternatively, spectators may second guess or agree with the listener or attempt to influence him. With the availability of the truth box, many different rules and methods of playing and types of games may be easily developed by the players.

It is therefore a principal object of the invention to provide a simple electronic game device which may be used by two players in a psychological game involving the truth or lack of truth of a speaker's statements.

It is another object of the invention to provide a device termed a truth box having push buttons by which players enter information into the box, and a set of indicators for scoring games played on the box.

It is yet another object of the invention to provide a truth box having a pilot lamp which will remain on for a selected time after start of a game to define a certain period of activity in the game.

It is still another object of the invention to provide a truth box having a set of scoring indicator lights which are not visible to the players during the game, but are made accessible when a game is finished.

These and other objects and advantages of the invention will become apparent upon reading of the detailed description of the invention in view of the drawings.

DETAILED DESCRIPTION OF THE PREFERRED EMBODIMENT

Figure 1:
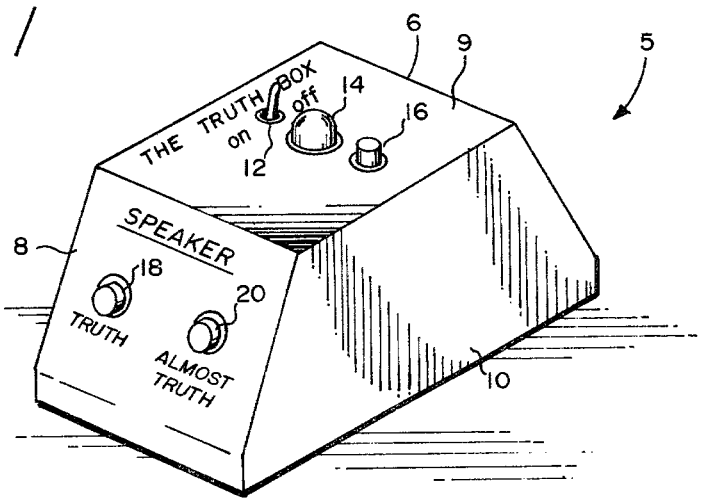
FIG. 1 is a perspective view of the cabinet of the invention showing the speaker's panel.

Referring to FIG. 1, a preferred cabinet arrangement for the invention is shown generally at 5. The cabinet is formed having a top surface 9, side surfaces 10, a SPEAKER panel surface 8 and a LISTENER panel surface 6, with the LISTENER panel best seen in FIG. 3. The SPEAKER panel surface 8 contains two momentary push buttons 18 and 20. Push button 18 is labeled TRUTH and is to be operated when the speaker in a game is telling the truth. Push button 20 is labeled ALMOST TRUTH and is to be operated when the speaker is varying from the truth. Top surface 9 contains the common controls for the device having an on/off toggle switch 12 which turns off the power when the device is not in use. A push button 16 is disposed in top surface 9, and is connected internally to a timer to be described below. When push button 16 is depressed, the timer is initiated causing indicator lamp 14 to be lighted. When the timer times out or reaches the end of a preselected period, light 14 is extinguished.

Figure 2:
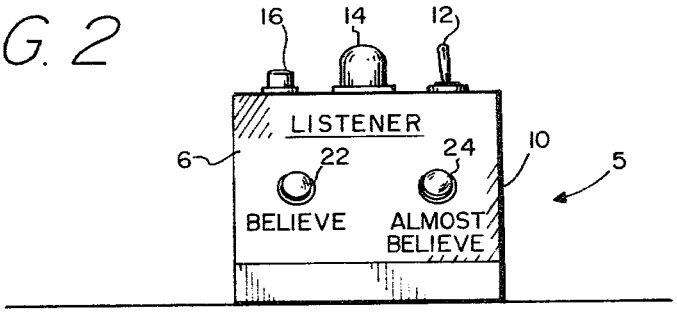
FIG. 2 is one end view of the cabinet of the invention showing the listener's panel.

Referring to FIG. 2, LISTENER panel 6, opposite from SPEAKER panel 8 of FIG. 1, is shown in end view and may be seen to include a first push button 22 which is labeled BELIEVE and a second push button 24 labeled ALMOST BELIEVE. Button 22 is to be momentarily depressed when the listener believes the speaker's statements are true while push button 24 is to be depressed when the listener believes the speaker's statements are not completely true.

Figure 3:
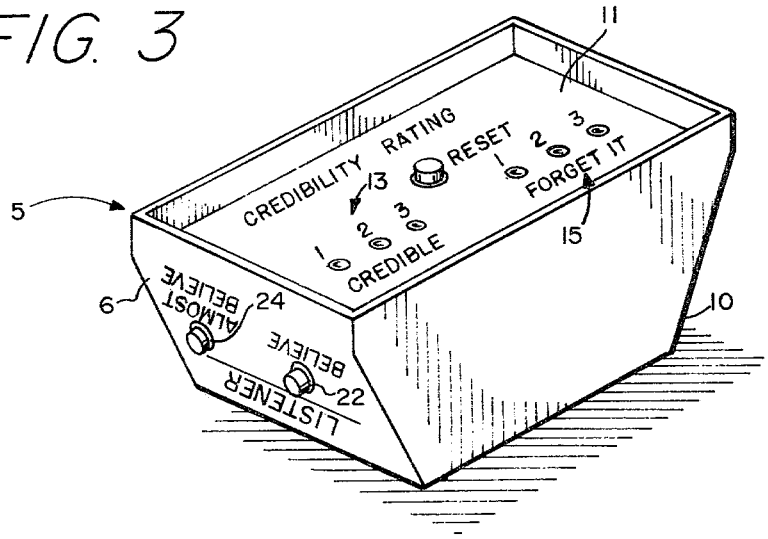
FIG. 3 is a perspective view of the cabinet of the invention in an inverted position for determining the score from the indicator light sets.

In FIG. 3, the cabinet of the invention is shown inverted, exposing a recessed bottom panel 11. Bottom panel 11 contains indicators for determining the "credibility rating" or score for the players after completion of a round of statements, questions, and answers. It is contemplated that a round of three statements, questions, and the like will be played. Panel 11 therefore contains a set of three indicator lights 13 which are labeled CREDIBLE. As will be described below, each time the listener is correct in his judgment of the speaker's statements, one of the CREDIBLE lamps will be lighted. Similarly, a set of three FORGET-IT lamps 15 are provided which will be illuminated when the listener is mistaken about the truth of the speaker's statements. It is to be noted that the CREDIBLE light and the corresponding FORGET-IT light are mutually exclusive and only one can be lit at any time. Thus, at the conclusion of a game, the winner will be the player having two or more of his indicator lamps lit.

Figure 4:
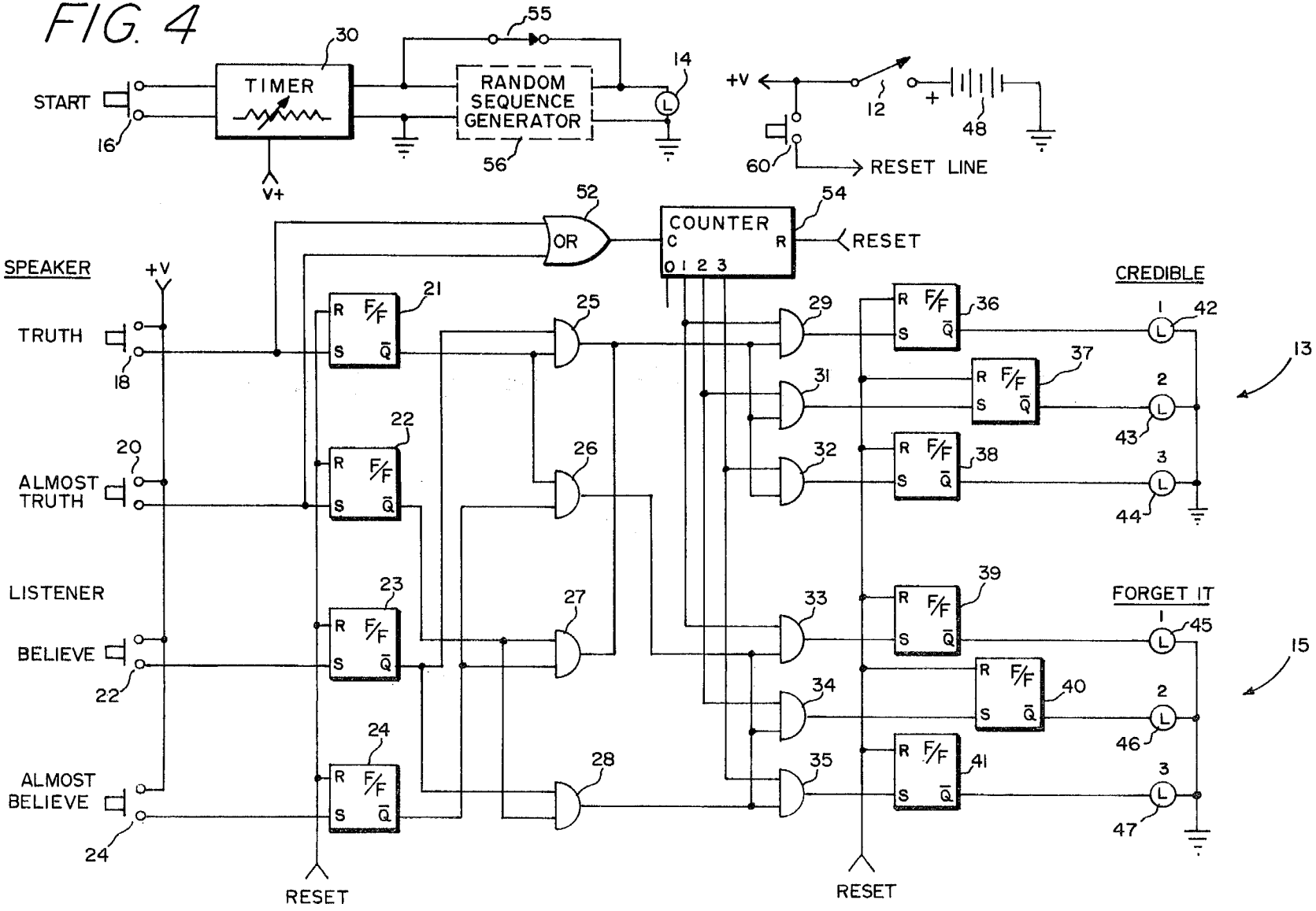
FIG. 4 is a functional and schematic diagram of the electrical circuit of the truth box.

Turning now to FIG. 4, a schematic diagram of the preferred embodiment of the electronic circuitry for the truth box is shown. Timer 30 is provided having an adjustible ON period. Depressing start switch 16 causes timer 30 to begin its operating cycle, illuminating the lamp 14. When timer 30 reaches the end of its period, light 14 which is preferably an LED, will be extinguished. Many timing circuits are suitable for implementation of timer 30, although a low cost and effective timer may be provided using a type NE555 linear integrated circuit. A small battery 48 is included within cabinet 5 for timer 30 as well as the remainder of the electronic logic circuits and light indicators. Switch 12 is used to remove power from the electronic circuits when the device is not being used. Push button 60 is used to place a HIGH condition on the reset line as shown. The CREDIBLE light set 13 is preferably composed of three LEDs: LED 42 for the first round, LED 43 for the second round, and LED 44 for the third round. Similarly, the set of FORGET-IT lamps 15 are LEDs: 45 for round 1, 46 for round 2, and 47 for round 3. Each lamp is controlled from its respective flip-flop. For example, flip-flop 36 controls lamp 32 causing it to light when flip-flop 36 has a HIGH level on its $\overline{Q}$ output. The indicator light control flip-flops 36-41 are set through interlocking logic elements in accordance with the buttons pressed by the listener and the speaker during the game.

The speaker push button 18 for TRUTH and 20 for AMOST TRUTH operates flip-flop 21 and 22, respectively. The listener push buttons 22 for BELIEVE and 24 for ALMOST BELIEVE operate flip-flop 23 and 24, respectively. A typical sequence of operations which causes CREDIBLE LED 42 to light is as follows:

The speaker presses TRUTH button 18 indicative of his speaking the truth. A HIGH level is applied to the set input S at flip-flop 21 causing it to switch, thereby placing a HIGH on the $\overline{Q}$ output. This HIGH represents an enable signal to AND gate 25. Assume that the listener believes the speaker is telling the truth and depresses push button 22. This sets flip-flop 23 causing a HIGH on its $\overline{Q}$ line to the other input of AND gate 25, enabling that gate such that a HIGH appears on its output lead to one input of AND gate 29. Note that, initially, flip-flops 22, 23 and 24 are all in their reset condition with a LOW on the $\overline{Q}$ output and gates 26, 27 and 28 a are inhibited. When either button 18 or 20 is depressed, a HIGH appears at one of the inputs of OR gate 52 whose output is connected to the CLOCK input of counter 54. Counter 54 is a three-bit counter which will step through outputs 1, 2, and 3 for each successive clock pulse input. Assuming at the beginning of the sequence being described, the counter is in its RESET or ZERO position. When a HIGH level appears at OR gate 52, counter 54 is stepped to place a HIGH on output line 1 connected to AND gate 29, enabling that gate causing a HIGH to appear at its output. It may be noted that counter output 1 also connects to one input of AND gate 33 but the other input of AND gate 33 is from inhibited AND gate 26 and will therefore have a LOW condition. Thus, a LOW will occur at the output of AND gate 33. When AND gate 29 is enabled, it sets flip-flop 36 to its $\overline{Q}$ state, energizing CREDIBLE LED 42 for round 1.

If the listener did not believe the speaker who had depressed TRUTH button 18, listener will depress ALMOST BELIEVE button 24. This action now sets flip-flop 24 producing a HIGH condition on its $\overline{Q}$ output to AND gate 26 with flip-flop 22 remaining in its reset condition with a LOW level on its Q output, inhibiting AND gate 25. AND gate 26 will therefore receive a HIGH on its first input from flip-flop 21 and on its other input from flip-flop 24. Thus, a high level will appear only on the output of AND gate 26 which enables the first input of AND gate 33. The HIGH from counter 54 on line 1 therefore causes gate 33 to set flip-flop 39. The Q output of flip-flop 29 will go HIGH, illuminating FORGET-IT LED 45 for round 1.

During the next round, the speaker and listener will depress the appropriate push buttons, causing counter 54 to step to place a HIGH on output line 3 causing either AND gate 31 or AND gate 34 to be enabled, depending upon which pair of buttons was depressed by the players. Therefore, either flip-flop 37 or flip-flop 40 will be set illuminating either the number 2 CREDIBLE LED 33 or the FORGET-IT number 2 LED 46. On the third round, counter 54 will step to place a HIGH on line 3 enabling either AND gate 32 or 35 and setting either flip-flop 38 or 41. It may be noted that the flip-flops associated with the first round indicators 42 and 35 and the second round indicators 43 and 46 will remain in the set positions until the game is complete. When all three rounds have been completed, truth box cabinet 5 is inverted as in FIG. 3. The indicator LEDs which were turned on for each round will remain illuminated to provide scoring. After scoring, reset button 50 is depressed momentarily placing a HIGH on the reset line, resetting counter 54 to its zero count position, resetting flip-flops 21, 22, 23 and 24, as well as flip-flops 36, 37, 38, 39, 40, and 41 as required. It may now be recognized that flip-flops 21, 22, 23, and 24 function to provide a temporary memory of which of which of the momentary contact buttons were pressed by the speaker and listener during a round. Thus, it is not necessary that the speaker and listener operate their push buttons simultaneously.

An optional feature may be included in accordance with the invention that may add additional suspense and interest to games that may be played. As shown in FIG. 4, a random sequence generator 56 is placed between LED 14 and timer 30, with switch 55 used to cut out generator 56 when desired. In this version, timer 30 is preferably adjusted to provide a long period such as two to five minutes. Generator 56 will produce random length pulses having durations varying from, for example, five seconds to twenty seconds. With switch 55 open and timer 30 operating, generator 56 will cause LED 14 to be on and off for random periods of time. The players must therefore carefully watch LED 14 to determine when the truth must be spoken. Random sequence generator 56 may use any of many well-known circuits. For example, noise diode which produces gaussian noise may have its output amplified and applied to a selectable threshold. Each time the noise peak crosses the threshold, a flip-flop is keyed either on or off, thereby producing random sequences of on/off pulses at each of its outputs.

Having shown a straight forward logic circuit configuration in FIG. 4, indicating discrete logic elements, it will be obvious to those of ordinary skill in the art that the device may be implemented with integrated circuits having a plurality of logic elements on a single chip resulting in a very low cost and compact assembly. Similarly, any of the many types of logic circuits may be used.

A preferred embodiment of a logic-type psychological game device has now been described which provides means for a speaker to enter into a logic circuit a signal indicative of the state of the speaker's statements at a given time and the listener to enter a signal indicative of his evaluation of the statements. After a round of three such statements, the device permits a score to be determined and means for resetting the device for another round. A timing device is included to permit definite limits to be set on certain portions of the game to be played. Due to the flexibility of the device, participants may develop various rules and scoring procedures, and may apply strategy in the formulation of statements, questions and answers to mislead the opponent to thereby enhance the pleasures and satisfactions of the game.

Although certain specific arrangements of the elements of the games have been shown, these are to be considered for exemplary purposes only and not to limit the invention. It will be obvious that many variations in the configuration of the cabinet, the location of the scoring lights, the number of rounds, and the type and disposition of the push buttons may be made. Similarly, the exemplary logic circuits shown may be modified through well known simplification algorithms to produce other circuits having the identical functions of the implementation shown. Also, mechanical switches, relays, and counting devices may be used. While a round of three has been illustrated, it is also obvious that any odd number of rounds may be provided for by the implementation and will allow a definite winner to be determined. Such variations and modifications are to be considered within the spirit and scope of the invention.

I claim:

1. A game device for two players comprising:

a housing having two opposed panels;

a pair of electric circuit completing push buttons disposed on each of said panels, one of said pair labeled to be related to a selected state of mind of a player and the other of said pair labeled to be related to the opposite state of such state of mind;

a logic circuit means connected to each of said push buttons for producing a control signal representative of the closure of one of said push buttons on each of said panels;

scoring indicator means connected to said logic circuit means responsive to said control signal for indicating the results of such closures;

counter means associated with said push buttons and said logic circuit means for providing a sequence of said control signal from said logic circuit means and in which said scoring indicator means is responsive to said sequence of control signals to indicate a plurality of results of a sequence of such closures;

timer means having a start button, said start button disposed in said housing; and indicator means connected to said timer means and disposed in said housing so as to be visible to the players, said indicator means controlled by said timer means to be operated for a sequence of random length time periods.

2. The device as defined in claim 1 in which said timer means includes:

a timer having a preselected fixed timing period; and a random sequence generator coupled to said timer, said generator enabled during said fixed timing period for controlling said indicator means for said sequence of random length time periods which are short relative to the length of said fixed timing period.

3. The device as defined in claim 1 in which:

the first of the pair of push buttons on one of said panels is labeled TRUTH and the other of the pair of push buttons is labeled ALMOST TRUTH;

the first of the pair of push buttons on the other of said panel is labeled BELIEVE and the other of the pair of push buttons is labeled ALMOST BELIEVE.

4. The device as defined in claim 3 in which said scoring indicator includes two sets of indicator lights and in which one of said sets is labeled CREDIBLE and the other of said sets is labeled FORGET IT.

* * * * *